US006106412A

United States Patent [19]

Kosugi et al.

[11] Patent Number: 6,106,412

[45] **Date of Patent: *Aug. 22, 2000**

[54] GOLF CLUB HEAD

[75] Inventors: Katsuhiko Kosugi; Kazuhiro Tsuchiya; Toshiharu Hoshi; Yoshimi Iitake, all of Hamamatsu, Japan

[73] Assignee: Yamaha Corporation, Shizuoka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,474

[22] Filed: Dec. 5, 1997

[30] Foreign Application Priority Data

Dec. 6, 1996 [JP] Japan ..... 8-326997

[51] Int. Cl.[7] ..... A63B 53/02

[52] U.S. Cl. ..... 473/305; 473/311

[58] Field of Search ..... 473/305–312; 419/27, 31, 38

[56] References Cited

U.S. PATENT DOCUMENTS

| | | | |
|---|---|---|---|
| 3,900,940 | 8/1975 | Gebhard, Jr. | 419/27 |
| 4,063,737 | 12/1977 | Tom et al. | 473/311 |
| 5,094,810 | 3/1992 | Shira | 419/31 |
| 5,326,106 | 7/1994 | Meyer | 473/305 |
| 5,556,097 | 9/1996 | Endo et al. | 473/309 |
| 5,611,740 | 3/1997 | Nagamoto | 473/305 |

*Primary Examiner*—Steven Wong
*Attorney, Agent, or Firm*—Koda & Androlia

[57] ABSTRACT

A wood or iron golf club head comprising a ball-striking part and a hosel which are formed separately and joined together into an integral unit, the hosel containing microscopic pores, thus having a lower material density compared to that of the ball-striking part.

3 Claims, 2 Drawing Sheets

GOLF CLUB HEAD

BACKGROUND OF THE INVENTION

1. Field of the Invention

The present invention relates to a golf club head and more particularly to a wood or iron golf club head which is made of metal.

2. Prior Art

In one type of conventional golf club head, the ball-striking member and shaft insertion member are formed as an integral unit by casting or forging from a metal material having the same composition. In another type of conventional golf club head, the ball-striking member and shaft insertion member are formed separately from a metal materials having the same composition or from different metal material having different specific gravities, so that the ball-striking member and shaft insertion member are joined together into an integral unit.

In these conventional golf club heads, however, the material density of the ball-striking member and the material density of the shaft insertion member are selected so as to be the same; accordingly, when an improvement is desired in ball-striking characteristics such as shock resistance, etc., it is necessary to change the cross-sectional shape of a ball-striking part of the ball-striking member or differentiate the compositions of the ball-striking member and shaft insertion member.

Recently, a shaft made from, for instance, a carbon-fiber-reinforced plastic (CFRP), which is a different material from the shaft insertion member made of metal, has been generally used; and when this type of shaft is inserted into a hole formed in the shaft insertion member so as to be bonded thereto, it is not always possible to obtain a strong bonding force from the adhesive agents used. This is because no adhesive agent is known which has a sufficient affinity for both the shaft and the shaft insertion member, which are made from different materials as described above.

Furthermore, the shaft which is inserted into the shaft insertion hole of the shaft insertion member generally has a tapered shape which gradually increases in diameter from the tip end portion to the grip end portion. Accordingly, in order to secure a good bonding strength, it is necessary to form the internal shape of the shaft insertion hole so as to perfectly coincide with the taper-form external shape of the tip end portion of the shaft so that a surface contact is made between the inner circumferential surface of the shaft insertion hole and the outer circumferential surface of the shaft.

However, forming such a shaft insertion hole requires a high degree of precision that is based on skill. If the hole is formed imperfect, the inner circumferential surface of the shaft insertion hole and the outer circumferential surface of the shaft make a point contact (and not a surface contact) with each other. As a result, the bonding surface area is conspicuously small, and the bonding strength is not sufficiently high. Consequently, the bonded area between the two parts are destroyed by the impact that occurs when the ball is hit during long-term repeated use, and the shaft eventually falls out of the shaft insertion hole.

Another means to increase the bonding strength between the shaft and shaft insertion hole is to roughen the outer circumferential surface of the shaft and the inner circumferential surface of the shaft insertion hole. With the roughened surfaces, the anchoring effect of the adhesive agent can increase. However, roughening of the inner circumferential surface of the shaft insertion hole is extremely difficult, though the outer circumferential surface of the shaft can, comparatively, be easily roughened.

SUMMARY OF THE INVENTION

Accordingly, the object of the present invention is to provide a golf club head in which the ball-striking characteristics such as shock resistance, etc., is easily adjustable, and the strength of the bond between the shaft and the shaft insertion hole is increased.

The above object is accomplished by a unique structure for a golf club head in which a ball-striking member and a shaft insertion member, which are formed as separate parts from metal materials, are joined together into a single unit, and the club head of the present invention is characterized in that microscopic pores are formed in the shaft insertion member so that the shaft insertion member has a lower material density than the ball-striking member.

In the above structure, it is preferable that the shaft insertion member be formed into a desired shape by injection-molding a powdered metal, and it is also preferable that the shaft insertion member and the ball-striking member be joined so that the shaft insertion member acts as a part of the ball-striking member. The ball-striking member and shaft insertion member can be made from a metal material having the same composition or from metal materials having different compositions.

DETAILED DESCRIPTION OF THE INVENTION

Figure 1:
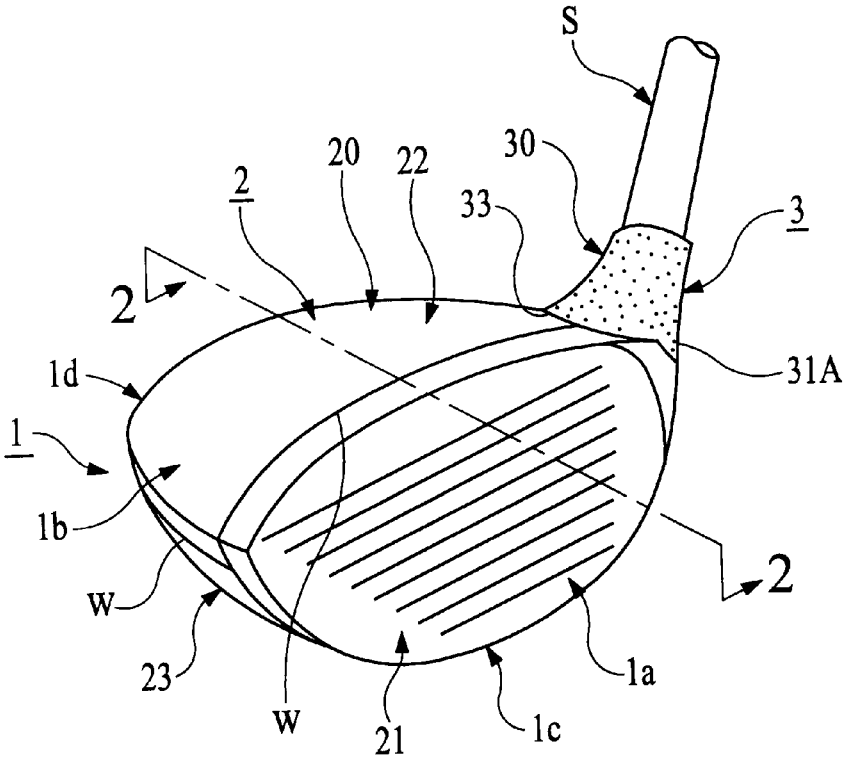
FIG. 1 is a perspective view of the golf club head according to one embodiment of the present invention.

One embodiment of the present invention will be described in detail with reference to the accompanying drawings; and in FIG. 1, the reference numeral 1 generally refers to a head which has a hollow outer shell structure made from a metal material.

The head 1 includes a ball-striking part 2, which has substantially a semi-ellipsoidal form, and a hosel part (merely called "hosel") 3, in which a shaft S made from a different material such as a CFRP, etc., is mounted. The ball-striking part 2 and the hosel 3 are formed separately; and a ball-striking member 20 of the ball-striking part 2 and a shaft insertion member 30 of the hosel 3 are joined together by welding at w so as to form an integral unit.

Figure 2:
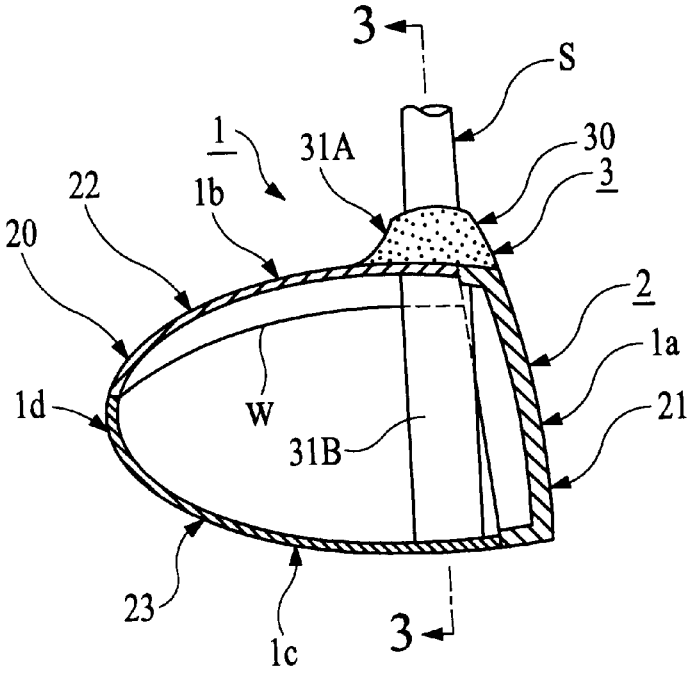
FIG. 2 is a sectional view taken along the line 2—2 in FIG. 1.
Figure 3:
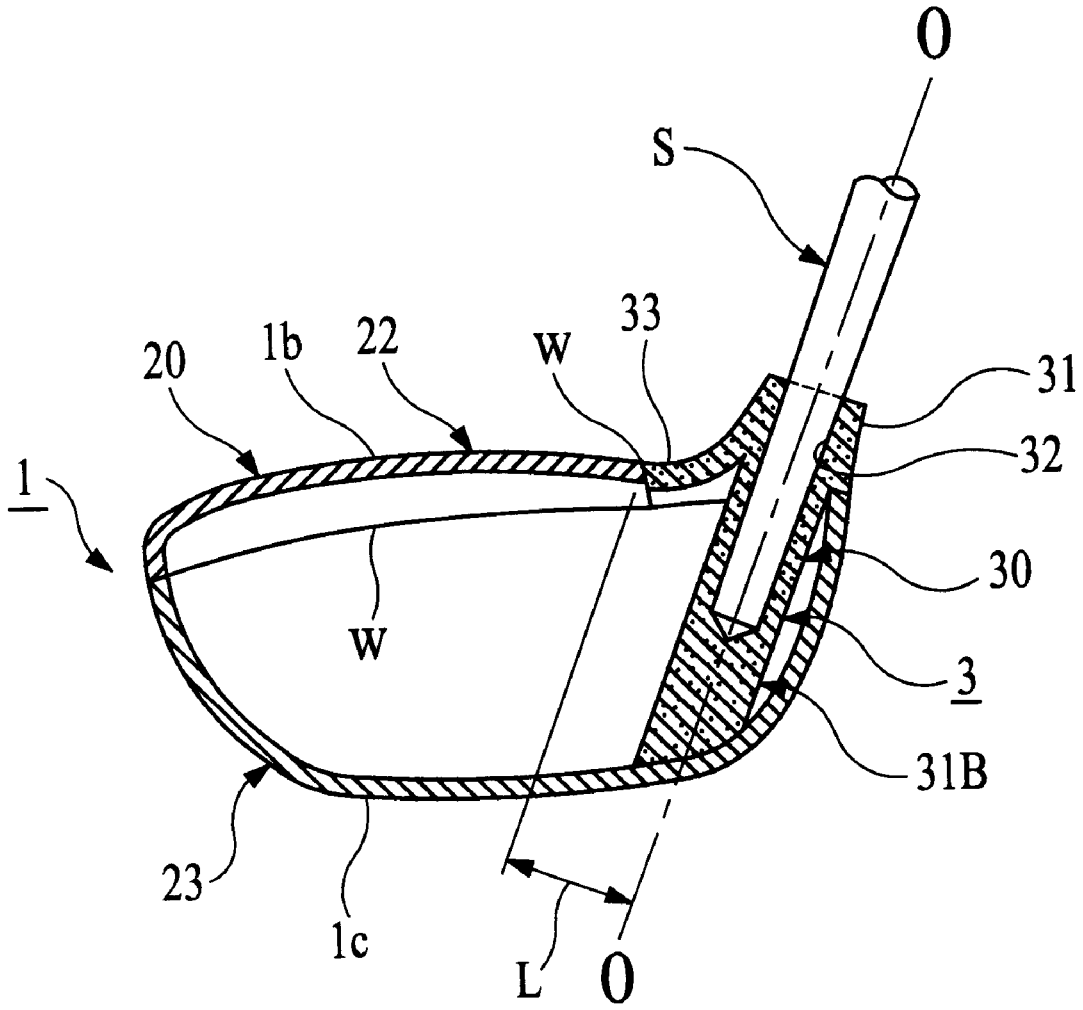
FIG. 3 is a sectional view taken along the line 3—3 in FIG. 2.

As shown in FIGS. 2 and 3, the ball-striking member 20 of the ball-striking part 2 has a shell structure that is obtained by combining 3 to 4 pieces of metallic parts. These parts include a ball-striking surface shell part 21 which forms a ball-striking surface (face surface) 1*a*; a top surface shell part 22 which forms a top surface (crown surface) 1*b*; and a peripheral surface shell part 23 which includes an integral bottom surface (sole surface) 1*c* and back surface 1 (the peripheral surface shell part 23 can be obtained from the bottom surface 1*c* and the back surface 1 combined). These shell parts 21, 22 and 23 are welded together at w so as to form an integral unit, the ball-striking member 20.

The shaft insertion member 30, on the other hand, is a rod-form metal material which contains microscopic pores formed by a method described later. This shaft insertion member 30 is formed with a density that is lower than the material density of the ball-striking member 20, and it has a shaft insertion hole 32 formed in the upper exposed end portion 31A thereof.

The shaft insertion hole 32 formed in this shaft insertion member 30 is arranged so that a shaft S is inserted into this hole 32 and bonded thereto by means of an adhesive agent. The lower portion 31B of the shaft insertion member 30 is, as best seen from FIG. 2, extended so that the end of the lower portion 31B abuts against the inside surface of the sole surface 1*c* of the ball-striking member 20. The end surface of this extended lower portion 31B is joined to the inside surface of the sole surface 1*c* of the circumferential shell part 23 by welding at w.

As best seen from FIG. 3, the shaft insertion member 30 has a projection 33 formed as an integral part thereof The projection 33 extends toward the toe of the head for a distance L which is from the central axis O—O of the shaft insertion member 30 to the boundary of the heel side end of the top surface shell part 22 of the ball-striking part 2. The distance L is in the range of approximately 7 to 50 mm. Thus, the projection 33 of the shaft insertion member 30 forms a part of the top surface shell part 22, thus serving as a part of the crown surface lb.

In the manufacture of the head 1, the ball-striking surface shell part 21, top surface shell part 22 and peripheral surface shell part 23 are respectively formed beforehand by processing a rolled material of titanium (Ti), a titanium alloy (Ti alloy), or the like in a method of pressing, super-plastic working, forging or the like.

On the other hand, the shaft insertion member 30 is formed into a desired shape by injection-molding a powdered metal. The powdered metal includes titanium (Ti), a titanium alloy (Ti-alloy) or the like in the form of powder that has the same composition as the material for the ball-striking member 20. The powdered metal can be aluminum (Al) or the like that has a different composition from the material for the ball-striking member 20.

The powdered metal injection-molding process referred to above is a process in which, for example, a raw material powder which has been fluidized by adding a binder such as a wax, resin, etc. to a finely powdered metal having a particle size of approximately 1 to 600 microns (preferably 10 to 100 microns) is injected into a mold and then molded, after which a shaft insertion member molding thus molded is formed by removing the binder and then being put in a sintering process. The resulting shaft insertion member 30 contains microscopic pores, so that the material density of the shaft insertion member 30 is lower than the material density of the ball-striking member 20.

In this case, where the material density of the ball-striking member 20 is 100, the ratio of the material density of the ball-striking member 20 to the material density of the shaft insertion member 30 is, for example, in the range of 100:99 to 100:85 and is preferably in the range of 100:99 to 100:94.

In the present invention, as a result of employment of the above construction, the ball-striking part 2 and hosel 3 of the head 1 are formed as separate members, and then the ball-striking member 20 of the ball-striking part 2 and shaft insertion member 30 of the hosel 3 are joined to each other by welding at w, thus forming an integral unit. Furthermore, the shaft insertion member 30 has microscopic pores so that the material density of the shaft insertion member 30 is lower than the material density of the ball-striking member 20. Accordingly, the ball-striking characteristics of the head such as the shock resistance, etc. can be adjusted by varying the ratio of the material density of the ball-striking part 20 to the material density of the shaft insertion member 30.

Accordingly, when elastic waves generated in the ball-striking part 2 during the hitting of the ball are propagated, these waves are attenuated by scattering and interference caused by the microscopic pores in the hosel 3, so that the sensation of hitting the ball is softened and the timbre of the impact sound that is generated when the ball is hit is improved.

Furthermore, when the pores in the hosel 3 are formed large in diameter, destruction of the bond with the shaft S which is inserted into the shaft insertion hole 32 of the hosel 3 and bonded thereto tends not to occur. As a result, the shaft S is prevented from slipping out of the shaft insertion hole 32.

Moreover, since the shaft insertion member 30 is made of a metal material that contains microscopic pores, the shaft insertion hole 32 has a roughened inner circumferential surface by way of the microscopic pores, and the bonding strength produced by the anchoring effect of the adhesive agent can be high even if the shaft S is made from a different material such as a CFRP, etc.

Furthermore, since the projection 33 formed on the shaft insertion member 30 is positioned so as to serve as a part of the ball-striking member 20, the material density of a portion of the ball-striking member 20 is lowered. Accordingly, the degree of freedom in adjusting the ball-striking characteristics of the head such as the shock resistance, etc. is increased.

Moreover, since the ball-striking part 2 and hosel 3 are separate members which are joined together, the hosel 3, in other words, possesses interchangeability. Accordingly, the hosel 3 can be varied in terms of performance and external appearance.

In addition, as a result of the lowered density of the shaft insertion member 30, an adjustment can easily be accomplished so as to prevent the position of the center of gravity of the head as a whole from being shifted toward the heel side of the club head.

In the above, the description is made with reference to a wood golf club head; however, the present invention is applicable to iron golf club heads.

As seen from the above, according to the present invention, the ball-striking member and shaft insertion member, which are formed as separate members, are joined to each other by welding to form an integral unit, and the shaft insertion member contains microscopic pores so that the material density of the shaft insertion member is lower than the material density of the ball-striking member. Accordingly, the sensation of hitting the ball can be adjusted according to the ball-striking characteristics of the head such as the shock propagation characteristics, etc. by varying the ratio of the material density of the ball-striking member to the material density of the shaft insertion member.

Furthermore, the vibration propagated as elastic waves from the ball-striking member when the ball is hit is attenuated by the shaft insertion member, so that the sensation and sound of striking the ball can be improved. Moreover, by designing the diameter of the pores in the shaft insertion member large, destruction of the bond with the shaft which is inserted into the shaft insertion hole of the shaft insertion member and bonded thereto tends can be avoided. Thus, the shaft is prevented form slipping out of the shaft insertion hole.

Furthermore, since the shaft insertion member is made from a metal material that contains microscopic pores, the inner circumferential surface of the shaft insertion hole is roughened by these microscopic pores, so that the joining strength produced by the anchoring effect of the adhesive agent entered into the pores can be increased even if the shaft S made from a different material such as a CFRP, etc. is used.

Moreover, since the projection formed on the shaft insertion member can serve as a part of the ball-striking member, the material density of a portion of the ball-striking member can be lowered, and therefore, the degree of freedom in adjusting the ball-striking characteristics of the head such as the shock resistance, etc. can be increased.

What is claimed is:

1. A golf club head in which a ball-striking member and a shaft insertion member are formed as separate parts from metal materials and joined together, said club head being characterized in that said shaft insertion member is provided with microscopic pores so that a material density of said shaft insertion member is lower than a material density of said ball-striking member and wherein materials of said ball-striking member and shaft insertion member have the same composition.

2. A golf club head in which a ball-striking member and a shaft insertion member are formed as separate parts from metal materials and joined together, said club head being characterized in that said shaft insertion member is provided with microscopic pores so that a material density of said shaft insertion member is lower than a material density of said ball-striking member and wherein said shaft insertion member is formed in a desired shape by injection-molding a powdered metal and wherein materials of said ball-striking member and shaft insertion member have the same composition.

3. A golf club head in which a ball-striking member and a shaft insertion member are formed as separate parts from a same metal material and joined interchangeably together, said club head further characterized in that said shaft insertion member is provided with microscopic pores so that a material density of said shaft insertion member is lower than a material density of said ball-striking member.

* * * * *